United States Patent [19]

Holdiman

[11] 4,122,633

[45] Oct. 31, 1978

[54] METHOD OF CLADDING A WINDOW PRODUCT

[75] Inventor: Joe W. Holdiman, Champaign, Ill.

[73] Assignee: Scovill Manufacturing Company, Dubuque, Iowa

[21] Appl. No.: 763,910

[22] Filed: Jan. 12, 1977

[51] Int. Cl.[2] ..... E06B 3/00

[52] U.S. Cl. ..... 49/501; 49/504; 52/727

[58] Field of Search ..... 49/501, 504, 505; 52/727; 160/236, 229 B, 220

[56] References Cited

U.S. PATENT DOCUMENTS

| | | | |
|---|---|---|---|
| 3,082,490 | 3/1963 | Lovcks | 52/727 |
| 3,443,345 | 5/1969 | Spencer | 49/504 X |
| 3,491,584 | 1/1970 | Selzer | 49/501 |
| 3,555,735 | 1/1971 | Weikert | 49/501 |
| 3,591,985 | 7/1971 | Coppins | 49/504 |
| 3,815,285 | 6/1974 | Kuyper | 49/501 |
| 3,879,894 | 4/1975 | Anderson | 49/501 X |

FOREIGN PATENT DOCUMENTS

| | | | |
|---|---|---|---|
| 2,122,257 | 12/1971 | Fed. Rep. of Germany | 49/501 |

*Primary Examiner*—Philip C. Kannan

*Attorney, Agent, or Firm*—Wegner, Stellman, McCord, Wiles & Wood

[57] ABSTRACT

A window product constructed from individually cladded members and a method of manufacturing the window product wherein individual wooden core members are cladded with a metal covering prior to the assembling of the window product. The window product requires minimum use of milled members having different cross-sectional configurations and the method of manufacture avoids the expense of applying a metal covering over an assembled window product and then forming mitered joints. The window product and its method of manufacture may include various configurations including casement windows, awning windows and picture windows.

7 Claims, 15 Drawing Figures

FIG. 7
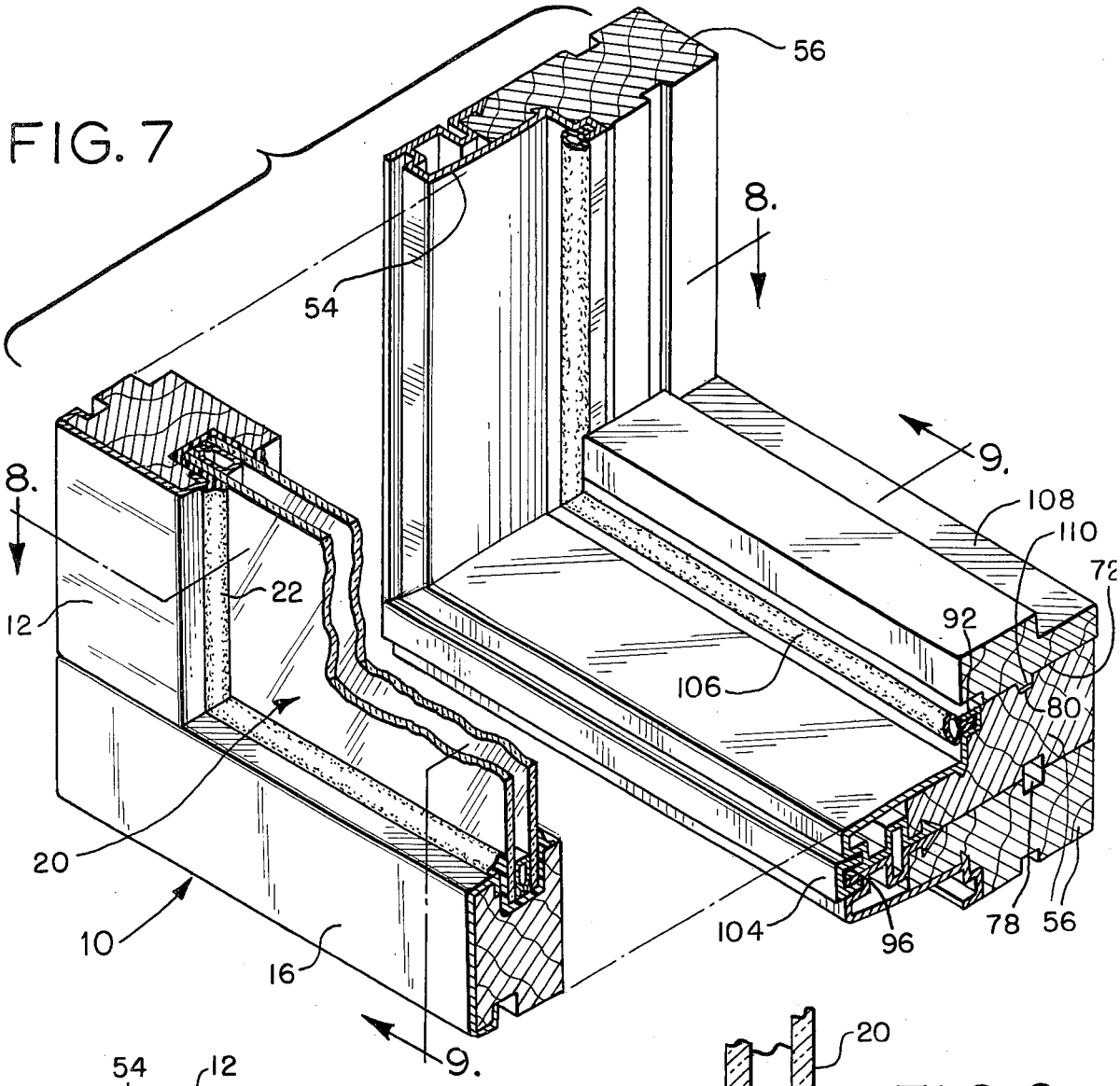
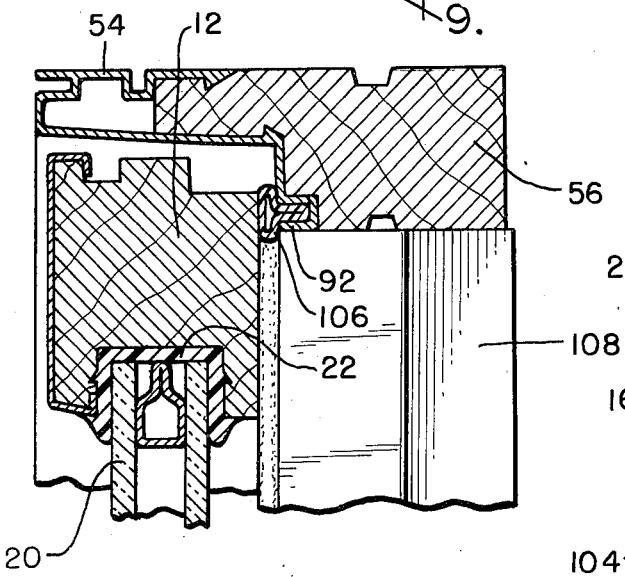
FIG. 8
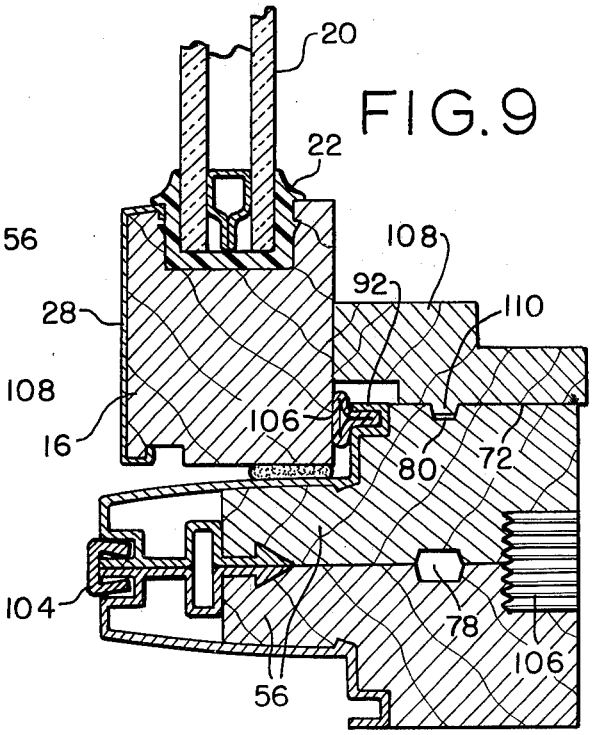
FIG. 9

METHOD OF CLADDING A WINDOW PRODUCT

BACKGROUND OF THE INVENTION

This invention relates to cladded window products and their method of manufacture and, more particularly, to wooden window products which are selectively cladded with a metal covering.

Wood is extensively used in the manufacture of windows and doors since it is readily available, easily milled, and has an attractive appearance. However, it is desirable to provide a coating on the exterior surface of the window or sliding door to protect the wood from the weather or other elements. As disclosed in U.S. Pat. No. 3,815,285, a metal, such as aluminum, is fixedly attached to the exterior side of the window or sliding door.

Prefabricated window products are usually manufactured at a single plant location. Each part is individually cut from wooden stock and subsequent manufacturing steps ultimately provide a finished window product. The above-cited patent employs the technique of completely assembling an entire window product and then selectively cladding the appropriate surfaces and sections to provide the finished product. This technique has several drawbacks. For example, assembly line backups are likely to develop if the cladding process cannot be accomplished on schedule. Each piece of metal cladding must be individually fit on a frame, and cutting tolerances may make this cut-and-fit technique expensive and time-consuming. Also, to provide a variety of different window products, many individual pieces of wood having different cross-sectional configurations must be milled. A significant number of different pieces are not interchangeable, and the lack of interchangeability results in an expensive window product. Also, the quality of the finished product substantially depends upon the skill of the personnel employed to effect the proper fit and to make the appropriate lap joints, especially at the miters.

Considering the drawbacks of the prior art, I have developed an attractive metal cladded window product which requires the minimum use of members having different cross-sectional configurations wherein each individual part is cladded before the assembly of the window product.

SUMMARY OF THE INVENTION

Rails and stiles are cut from wooden stock and a preformed metal extrusion is attached to selected surfaces. The stiles and rails are individually cladded with the preformed metal extrusion and the ends of the metal are folded or tucked under at the ends of the stiles or rails to provide an individual finished metal component which, when assembled, yields a complete window frame. A glazing gasket around the perimeter of the glazing panel in the frame aids in retaining the metal cladding against the wood. Longitudinally extending hooks on the interior surface of the metal extrusion grip the wood for added retention of the metal.

A milled core casing member has a metal extrusion selectively disposed on one side thereof with two mating surfaces. The framing member is used as a jamb in an assembled window product. When the casing member is coupled to a similar casing member at the mating surfaces, a sill or head of the window is provided. The cladded jambs, sill and head are assembled to form the casing. Different configurations of window products may be constructed from the metal cladded core casing members.

A principal feature of the invention is to minimize the number of parts of different cross-sectional configurations in the assembly of a window product.

Another feature of the invention is to provide a method of manufacturing a window product which permits the cladding of individual parts thereof prior to assembling the completed window product.

Another feature of the invention is to provide a cladded window product which, when assembled, does not require miters at the joints between the stiles and the rails.

Yet another feature of the invention is to provide a variety of window products including casement windows, awning windows and picture windows.

Other features of the invention will become apparent after reviewing the specification and the drawings in which:

DRAWINGS

FIG. 1 is a perspective view of a window frame constructed in accordance with the present invention;

FIGS. *2a–2e* are broken perspective views of stile and rail assemblies which form the window frame of FIG. 1;

FIG. 3 is a cross-sectional view of the joint between the stile and the rail of FIG. *2a;*

FIG. 7 is a cross-sectional perspective view of a corner having the window frame of FIG. 1 received within the casing constructed from the casing members of FIG. 4;

FIG. 8 is a cross-sectional view taken through the stile and jamb of the assembly shown in FIG. 7;

FIG. 9 is a cross-sectional view taken through the rail and sill of the assembly shown in FIG. 7;

Figure 10A:
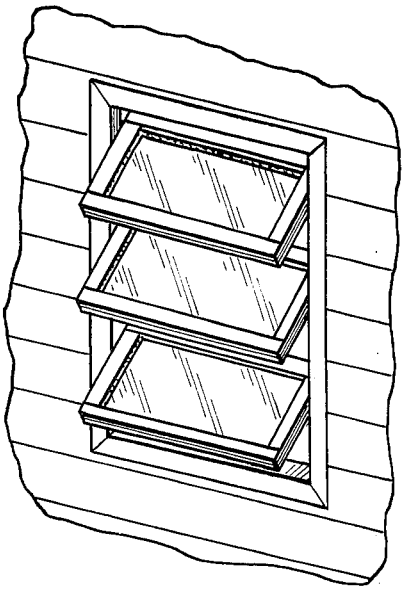
Figure 10B:
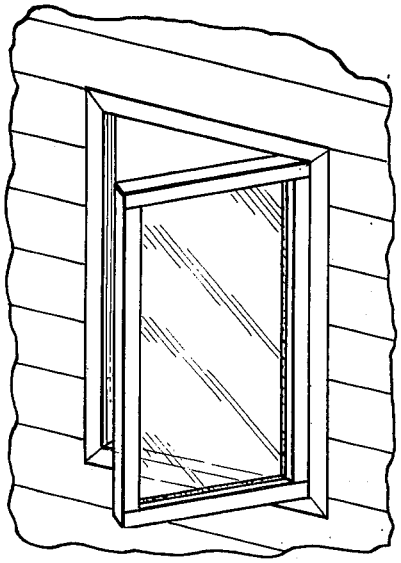

FIG. 10*a* is a perspective view of an awning window manufactured in accordance with the present invention; and FIG. 10*b* is a perspective view of a casement window manufactured in accordance with the present invention.

DETAILED DESCRIPTION OF PREFERRED EMBODIMENTS

Figure 2:
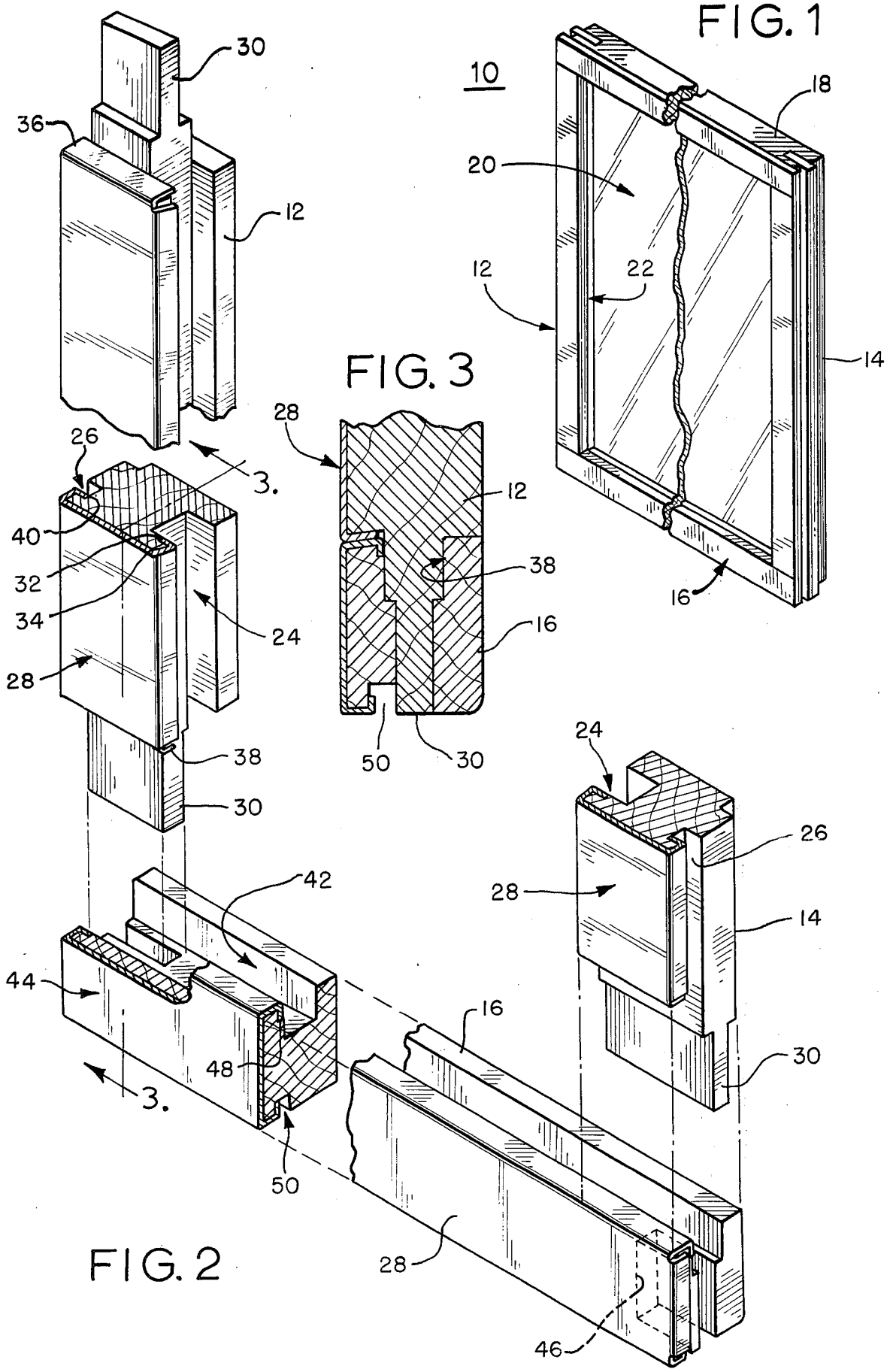
Figure 2B:
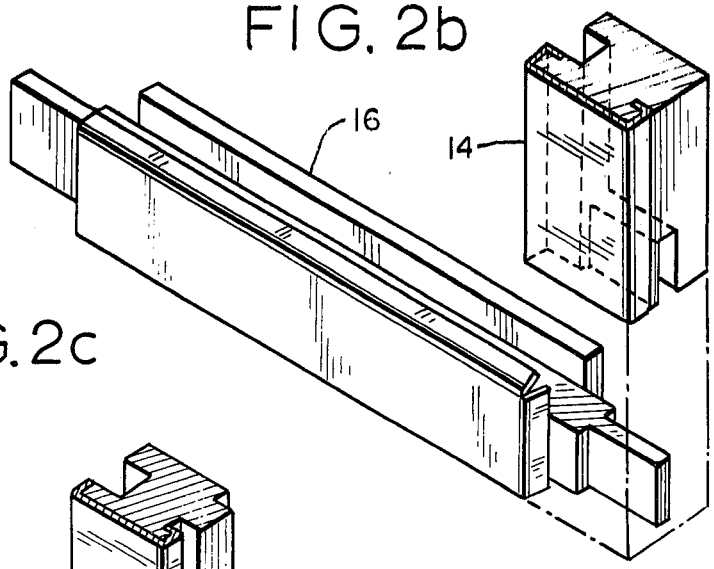
Figure 2C:
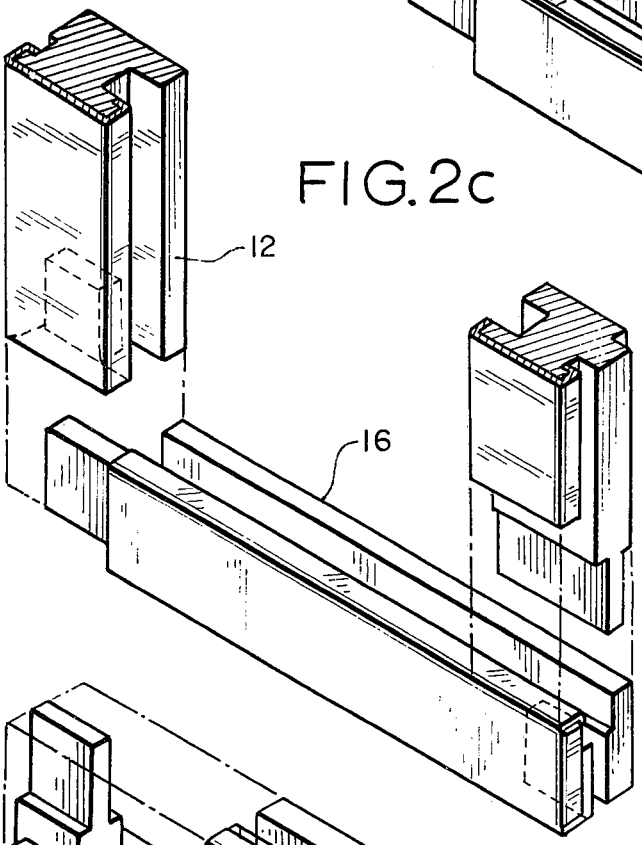
Figure 2D:
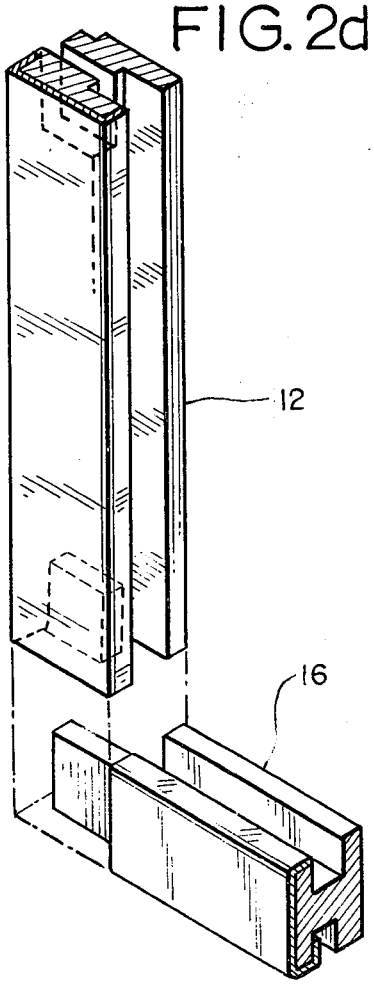
Figure 2E:
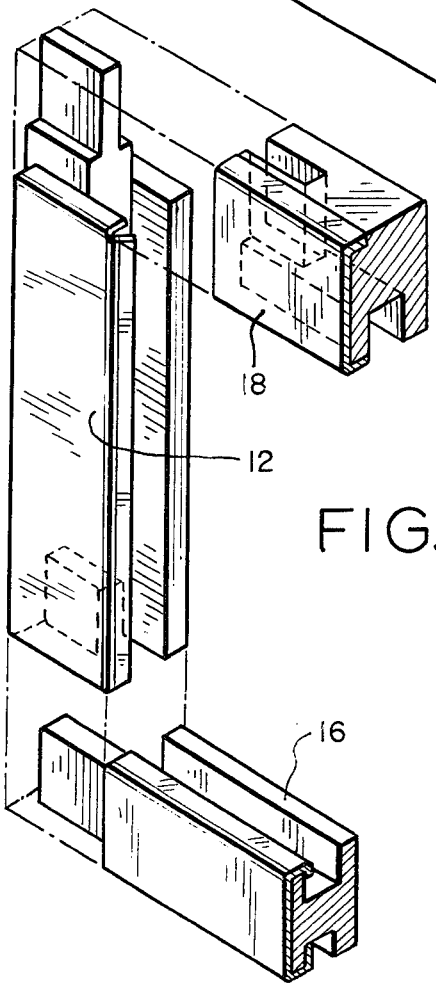

Referring to FIGS 1–3, a window frame assembly 10 is shown. The window frame assembly 10 has two stiles 12 and 14 which are substantially parallel to each other and receive rails 16 and 18 at each end to form a joint. Glazing panel assembly 20 is held in place by the stiles and the rails, and hence a window frame assembly 10 is formed. Although the window frame assembly 10 is shown to be rectangular, the shape depends upon the type of window to be constructed. A glazing gasket 22 provides a resilient cushion for the glazing panel assembly 20 against the stiles 12 and 14 and rails 16 and 18 while at the same time it aids in the retention of the metal cladding against the stiles and the rails. The glazing panel assembly 20 may be a single pane of glass or plastic or may be formed from two panels of glass or plastic separated by a spacer to form an insulated window.

Stile 12, which is similar to stile 14, is milled from a piece of wood or other suitable material to have a longitudinally extending rabbet 24 of a width sufficient to receive the glazing panel assembly 20 and the glazing gasket 22. Stiles 12 and 14 are provided with an outwardly opening slot 26 which extends the length of the stile along the surface of the side opposite the rabbet 24. The slot 26 acts as a relief plow as well as a groove to accept and retain preformed metal cladding 28. Each of the ends of stiles 12 and 14 receives a rail to form a miterless joint. As shown in FIG. 2*a* tenon 30 is provided at each end of stile 12, which is adapted to be received within a mortise at the end of rail members 16 and 18. Although stile 12 is shown to have a tenon on each end, as shown in FIG. 2*a* it should be understood that any combination of mortise and tenons provided at the ends of the stiles 12 and 14 would be acceptable so long as rails 16 and 18 are adapted to receive their ends, as depicted by FIGS. 2*b–e*.

The outer surfaces of stiles 12 and 14 are provided with a metal extrusion or cladding 28. The cladding may be formed from aluminum and has a cross section as shown. The metal cladding may be applied to stile 12 by sliding it over the surface so that lip 32 is received by channel 34 adjacent rabbet 24, and lip 40 is received in slot 26. The cladding 28 is perforated at its ends 36 and 38 and folded over the outer surface of stiles 12 and 14. The folded ends 36 and 38 retain cladding 28 on stiles 12 and 14 to form individually cladded stile members.

The construction of cladded rails 16 and 18 is similar to the construction of stiles 12 and 14. In fact, the rails and stiles may be formed from the same milled stock. Rabbet 42 traverses the inner surface of rail 16 from end 44 to end 46, and has a width equal to rabbet 24. A channel 48, similar to channel 34, is provided adjacent the rabbet 42. Also, slot 50, opposite rabbet 42, is similar to slot 26 on stile 12. Metal cladding 28 is received by the outer surface of rail 16 and is perforated and folded over at ends 44 and 46 to retain the metal cladding on the rail to form individually cladded rail members 16 and 18. Although the rail is shown to have a mortise at each of its ends 44 and 46, it should be apparent that either a tenon or mortise at the end would be acceptable as long as the stile member 12 or 14 is adapted to accommodate the end. When rails 16 and 18 and stiles 12 and 14 are joined, a continuous groove is formed around the perimeter of the frame for receiving the glazing panel assembly 20. The joints between the stiles and the rails may be secured by glue, nails or screws (not shown) to form the frame assembly 10. A completed window frame assembly 10 is placed within its appropriate window casing. The frame assembly 10 may be rigidly attached to the casing with screws or the like or, alternatively, it may be mounted to the casing with the appropriate window hardware for permitting movement of the window with respect to the casing. Although the frame assembly can be used for virtually any type of window product construction, it is particularly well suited for use in the manufacture of casement windows, awning windows and picture windows, as will be explained below.

Figure 4:
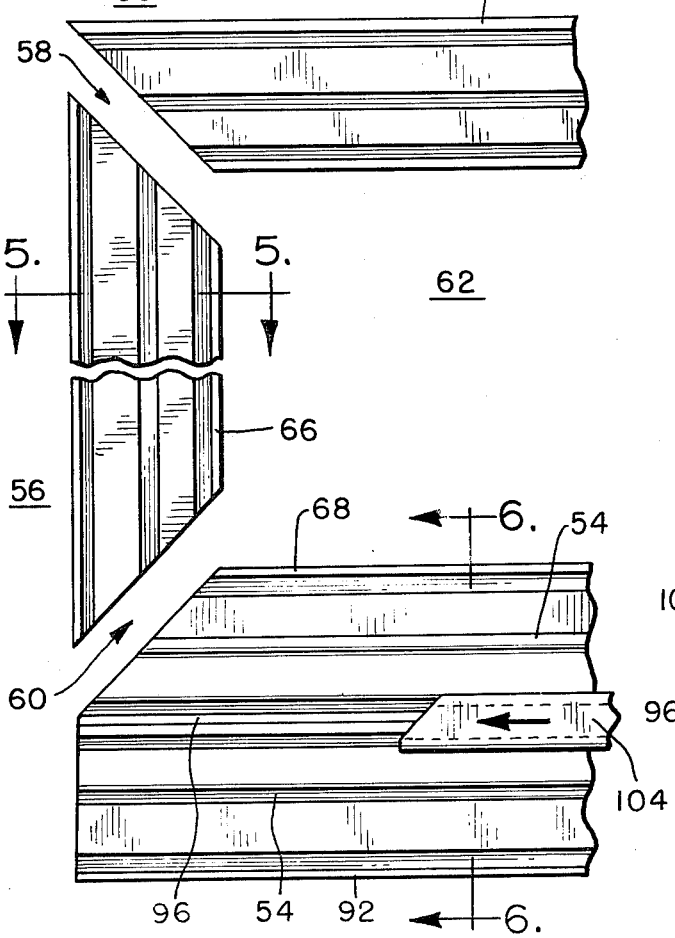
FIG. 4 is a top view of cladded casing members having mitered ends and used to form the casing which receives the window frame of FIG. 1.
Figure 5:
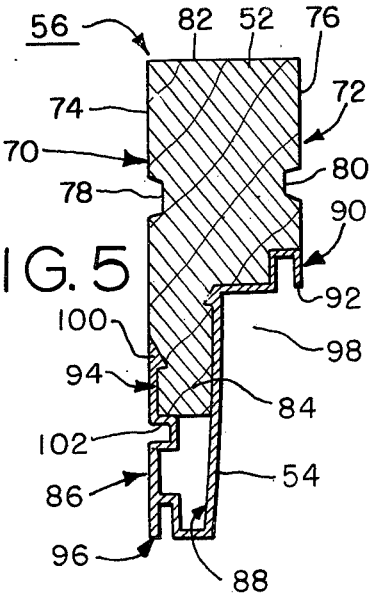
FIG. 5 is a cross-sectional view of the cladded casing member shown in FIG. 4.
Figure 6:
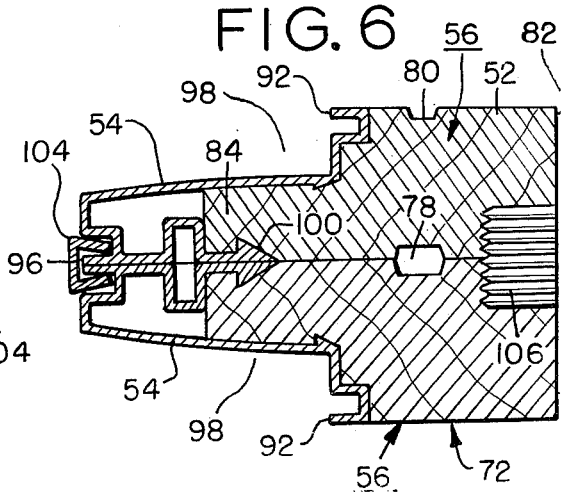
FIG. 6 is a cross-sectional view of the casing member shown in FIG. 4 mated with a similar casing member to form a head or sill.

Referring to FIGS. 4–6, the window casing particularly adapted to receive the window frame assembly 10 is shown. A milled core member 52 is of a shape to receive preformed metal extrusion 54. The extrusion 54 may be of aluminun and slid onto the core member 52 or may be snapped thereover. The combination of the core member 52 and the metal extrusion 54 forms a cladded casing member 56. The cladded casing member 56 may be used as a jamb or a head in the assembled window casing. A pair of cladded casing members 56, assembled back-to-back, may be used to form a head or a sill of the assembled window casing. Also, two casing members 56 may be attached to form a double window product wherein the assemblies are positioned side by side. As shown in FIG. 4, the cladded casing member 56 may be mitered at its end to form joints 58 and 60 and appropriately secured by staples, glue or nails at the joints. A casing 62 is thus formed by head 64, jamb(s) 66 and sill 68. The size and shape of casing 62, of course, depends upon the type and size of the window product to be constructed.

The construction of cladded frame member 56 will now be described. Two mating surfaces 70 and 72 are adapted to receive a similar mating surface of an identical cladded casing member 56. Core member 52 has a generally flat primary mating surface 74 and a generally flat secondary mating surface 76, which surfaces are substantially parallel to each other. Each surface 74 and 76 has an opposing half-channel 78 and 80, respectively, the purpose of which will be explained below. Inner surface 82 spans the distance between the primary and secondary mating surfaces, and a haunched outer surface 84 is adapted to receive the preformed metal extrusion 54. The preformed metal extrusion 54 has an exterior surface 86 and an interior surface 88. The exterior surface 86 has a front side 90 which is generally coplanar with the secondary mating surface 76 to form mating surface 72, and has a ridge 92 which traverses the extrusion 54 from end to end. Similarly, the rear side 94 of the extrusion 54 is generally coplanar with the primary mating surface 74 to form mating surface 70. Rear side 94 has a ridge 96 which traverses the extrusion 54 from end to end. Recess 98 extends from the front side 90 outwardly along the haunched outer end 84 and is adapted to receive frame assembly 10. The interior surface 88 of the preformed metal extrusion 54 has hook-type barbs 100 which traverse the length of the core member 52 to retain metal extrusion 54. Also, an inwardly extending lateral protrusion 102 may be formed in the metal extrusion to further aid in the retention of the cladding against the core member 52.

Ridges 92 and 96 receive an interconnecting mullion 104 in the event that two cladded casing members 56 are coupled together to form a sill or a head, or for interconnection, side by side. A coupling of two casing members 56 can be made on either mating surface 70 or mating surface 72, in which event core members 52 may be secured by staples 106 driven into the inner surface 82.

Referring to FIGS. 7–9, window frame assembly 10 is to be received by an assembly constructed of cladded casing members 56 to provide a window product. The frame assembly 10 is shown to have a double pane glazing panel 20 and glazing gasket 22 wherein the glazing gasket 22 aids in retaining the cladding 28 against the stile 12 and the rail 16. The frame assembly 10 is received at the recess 98 of the assembled cladded casing.

As shown, the cladded casing has a sill constructed of two casing members 56 interconnected with mullion 104. The window product could, if desired, be interconnected to a similar window product, side by side along the jamb. A rod (not shown) may be driven into the opposing half-channels 78 to preclude slippage of interconnected cladded casing members 56. Weather stripping 106 may be provided in the channel created by the ridge 92 around the perimeter to aid in the sealing of the window frame assembly 10 with respect to the jamb, sill and head. The weather stripping may be of any suitable resilient material capable of flexing upon the engagement of the frame assembly 10 against it. Trim 108 having a protrusion 110 may be affixed to mating surface 72. A half-channel 80 aids in the retention of the trim.

FIGS. 10*a* and 10*b* typify the window products which may be constructed in accordance with this invention. Specifically, referring to FIG. 10*a*, three awning type window assemblies similar to those shown in FIG. 1 are mounted on a casing similar to that shown in FIG. 7. The window is provided with suitable hardware to manipulate the opening thereof. FIG. 10*b* shows a typical casement window employing the window construction similar to that of FIG. 1 and disposed within the window casing similar to that of FIG. 7. Although the window in FIG. 10*b* is shown to open and close, it should be understood that if it were appropriately secured to the casing, a picture window could also be formed.

I claim:

1. A window product having a metal cladding applied to selected portions thereof comprising:

a first elongated milled element having a front and a rear face and an outwardly opening rabbet located on a side between the front and the rear faces thereof, said rabbet adapted to receive a glazing panel assembly traversing the first milled element therefor from a first end to a second end, the first end and the second end thereof adapted to receive a second milled element to form a miterless joint, a metal cladding covering said front side and extending into the rabbet, said cladding folded at each of the first and second ends thereof for retaining the cladding in engagement with the first milled element therefor.

2. The window product as claimed in claim 1 wherein a tenon is provided at the first end and the second end of the first milled element, said tenon adapted to be received by a mortise in the second milled element.

3. The window product as claimed in claim 1 wherein a mortise is provided at the first end and the second end of the first milled element, said mortise adapted to be received by a tenon on the second milled element.

4. The window product as claimed in claim 1 wherein a tenon is provided at the first end of the first milled element adapted to be received by a mortise in the second milled element; and a mortise is provided at the second end of the first milled element, said mortise adapted to receive the tenon from said second milled element.

5. The window product as claimed in claim 1 wherein a continuously outwardly opening slot traverses the first milled element from end to end on a side opposite the side on which is located the outwardly opening rabbet, said metal cladding extending into and retained by the slot.

6. The window product as claimed in claim 1 wherein the glazing panel assembly includes a resilient gasket lining the rabbet and a pair of glazing panels separated by an elongated spacer, said glazing panels and said spacer disposed within the gasket.

7. A window product having metal cladding applied to selected portions thereof comprising:

a first elongated milled rail having a front and a rear face and an outwardly opening rabbet located on a side between the front and the rear faces thereof, said rabbet adapted to receive a glazing panel assembly traversing the first elongated milled rail from a first end to a second end, the first end and the second end thereof adapted to receive a stile to form a miterless joint, a metal cladding covering said front and extending into the rabbet, said cladding folded at each of the first and second ends thereof for retaining the cladding in engagement with the first elongated milled rail; and a second elongated milled rail substantially identical to the first elongated milled rail;

a elongated milled stile having a front and a rear face and an outwardly opening rabbet located on a side between the front and the rear faces thereof, the rabbet adapted to receive a glazing panel assembly traversing the rail from a first end to a second end, the first end and the second end thereof adapted to receive a rail to form a miterless joint, a metal cladding covering said front side and extending into the rabbet, said cladding folded at each of the first and second ends thereof for retaining the cladding in engagement with the stile;

a second elongated milled stile substantially identical to the first elongated milled stile;

wherein the first and second ends of the first and second elongated milled rails are joined to the first and second ends of the first and second ends of the first and second elongated milled stiles.

* * * * *